US008773225B1

(12) United States Patent
Vahidpour et al.

(10) Patent No.: US 8,773,225 B1
(45) Date of Patent: Jul. 8, 2014

(54) WAVEGUIDE-BASED APPARATUS FOR EXCITING AND SUSTAINING A PLASMA

(71) Applicant: Agilent Technologies, Inc., Loveland, CO (US)

(72) Inventors: Mehrnoosh Vahidpour, Santa Clara, CA (US); Miao Zhu, San Jose, CA (US); Geraint Owen, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 134 days.

(21) Appl. No.: 13/839,028

(22) Filed: Mar. 15, 2013

(51) Int. Cl.
*H01P 1/208* (2006.01)
*H01P 7/06* (2006.01)
*H01P 5/00* (2006.01)

(52) U.S. Cl.
USPC ... 333/248; 333/113; 333/99 PL; 315/111.21; 356/316; 343/771

(58) Field of Classification Search
USPC ..... 315/111.21; 333/248, 113, 99 PL; 356/316; 343/771
See application file for complete search history.

(56) References Cited

U.S. PATENT DOCUMENTS 4,721,933 A * 1/1988 Schwartz et al. ..... 333/212
4,812,790 A * 3/1989 Tatomir et al. ..... 333/212
5,010,351 A * 4/1991 Kelly ..... 343/771
6,683,272 B2 1/2004 Hammer
7,030,979 B2 * 4/2006 Hammer ..... 356/316
8,039,795 B2 10/2011 Mordehai et al.

OTHER PUBLICATIONS

A. Sotgiu et al. "Electric fields and losses in lumped element resonators for ESR spectroscopy", J. Phys. E: Sci. Instrum. 20 (1987) pp. 1487-1490.
Michael R. Hammer, "A magnetically excited microwave plasma source for atomic emission spectroscopy with performance approaching that of the inductively coupled plasma", Spectrochimica Acta Part B 63 (2008), pp. 456-464.
Merdad Mehdizadeh, et al., "Loop-Gap Resonator: A Lumped Mode Microwave Resonant Structure", IEEE Transactions on Microwave Theory and Techniques, Vol. MTT-31, No. 12, Dec. 1983, pp. 1059-1064.
W. N. Hardy et al., "Split-ring resonator for use in magnetic resonance from 200-2000 MHz", Rev. Sci. Instrum. 52(2), Feb. 1981, pp. 213-216.

* cited by examiner

*Primary Examiner* — Nikita Wells

(57) ABSTRACT

An apparatus includes: an electromagnetic waveguide and an iris structure providing an iris in the electromagnetic waveguide. The iris structure defines an iris hole. The apparatus further includes an electric field rotation arrangement configured to establish a 2N-pole electric field around a circumference of the iris hole, wherein N is an integer which is at least two. The electric field rotation arrangement may include at least four iris slots, each in communication with the iris hole, wherein a first one of the iris slots is further in disposed at a first side of the iris hole and a second one of the iris slots is disposed at a second side of the iris hole which is opposite the first side.

17 Claims, 8 Drawing Sheets

WAVEGUIDE-BASED APPARATUS FOR EXCITING AND SUSTAINING A PLASMA

BACKGROUND

Emission spectroscopy based on plasma sources is a well accepted approach to elemental analysis. It is desired that an electrical plasma suitable as an emission source for atomic spectroscopy of a sample should satisfy a number of criteria. The plasma should produce desolvation, volatilization, atomization and excitation of the sample. However the introduction of the sample to the plasma should not destabilize the plasma or cause it to extinguish.

One known and accepted plasma source for emission spectroscopy is a radio frequency (RF) inductively coupled plasma (ICP) source, typically operating at either 27 MHz or 40 MHz. In general, with an RF ICP source the plasma is confined to a cylindrical region, with a somewhat cooler central core. Such a plasma is referred to as a "toroidal" plasma. To perform spectroscopy of a sample with an RF ICP source, a sample in the form of an aerosol laden gas stream may be directed coaxially into this central core of the toroidal plasma.

Although such plasma sources are known and work well, they generally require the use of argon as the plasma gas. However, argon can be somewhat expensive and is not obtainable easily, or at all, in some countries.

Accordingly, there has been ongoing interest for many years in a plasma source supported by microwave power (for example at 2.45 GHz where inexpensive magnetrons are available) which can use nitrogen, which is cheaper and more widely available than argon, as the plasma gas.

However, emission spectroscopy systems based on microwave plasma sources have generally shown significantly worse detection limits than systems which employ an ICP source, and have often been far more demanding in their sample introduction requirements.

For optimum analytical performance of the emission spectroscopy system, it is thought that the plasma should be confined to a toroidal region, mimicking the plasma generated by an RF ICP source.

It turns out to be much more difficult to produce such a toroidal plasma using microwave excitation than it is in for RF ICP source. With an RF ICP source, a current-carrying coil, wound along the long axis of a plasma torch, is used to power the plasma. The coil produces a magnetic field which is approximately axially oriented with respect to the long axis of the plasma torch, and this, in turn, induces circulating currents in the plasma, and these currents are symmetrical about the long axis of the plasma torch. Thus, the electromagnetic field distribution in the vicinity of the plasma torch has inherent circular symmetry about the long axis of the plasma torch. So it is comparatively easy to produce a toroidal plasma with an RF ICP source.

However, the waveguides used to deliver power to microwave plasmas do not have this type of circular symmetry, and so it is much more difficult to generate toroidal microwave plasmas.

There is therefore a desire to provide an improved microwave plasma source which can offer performance which approaches that of RF ICP, together with characteristics such as small size, simplicity and relatively low operating costs.

BRIEF DESCRIPTION OF THE DRAWINGS

The representative embodiments are best understood from the following detailed description when read with the accompanying drawing figures. Wherever applicable and practical, like reference numerals refer to like elements.

DETAILED DESCRIPTION

In the following detailed description, for purposes of explanation and not limitation, illustrative embodiments disclosing specific details are set forth in order to provide a thorough understanding of embodiments according to the present teachings. However, it will be apparent to one having had the benefit of the present disclosure that other embodiments according to the present teachings that depart from the specific details disclosed herein remain within the scope of the appended claims. Moreover, descriptions of well-known devices and methods may be omitted so as not to obscure the description of the example embodiments. Such methods and devices are within the scope of the present teachings.

Generally, it is understood that as used in the specification and appended claims, the terms "a", "an" and "the" include both singular and plural referents, unless the context clearly dictates otherwise. Thus, for example, "a device" includes one device and plural devices.

As used in the specification and appended claims, and in addition to their ordinary meanings, the terms "substantial" or "substantially" mean within acceptable limits or degree. For example, "substantially cancelled" means that one skilled in the art would consider the cancellation to be acceptable. As a further example, "substantially removed" means that one skilled in the art would consider the removal to be acceptable.

The present teachings relate generally to an apparatus including a waveguide useful in combination with a plasma torch to generate and sustain a plasma useful in spectroscopic analysis. The present inventors have conceived and produced novel iris structures for a waveguide which may cause the electric field in the waveguide to experience a phase shift or change in direction across the iris structure from a first side of the iris structure to a second side of the iris structure opposite the first side. Here, an iris is defined as a region of discontinuity inside the waveguide which presents an impedance mismatch (a perturbation) that blocks or alters the shape of the pattern of an electromagnetic field in the waveguide. In some embodiments, the iris can be produced by a reduction in the height and width of the interior of the waveguide, as is discussed in greater detail below.

In particular, the present inventors have discovered that by certain iris structure configurations, the electric field may be caused to experience a phase shift of 180 degrees across the iris structure producing a reversal in direction of the electric field from the first side of the iris structure to the second side of the iris structure such that the electric field at the second side of the iris structure is in an opposite direction from the electric field at first side of the iris structure. By employing these configurations, a suitable plasma shape may be generated. A more detailed explanation will be provided in connection with example embodiments illustrated in the attached drawings.

Figure 1:
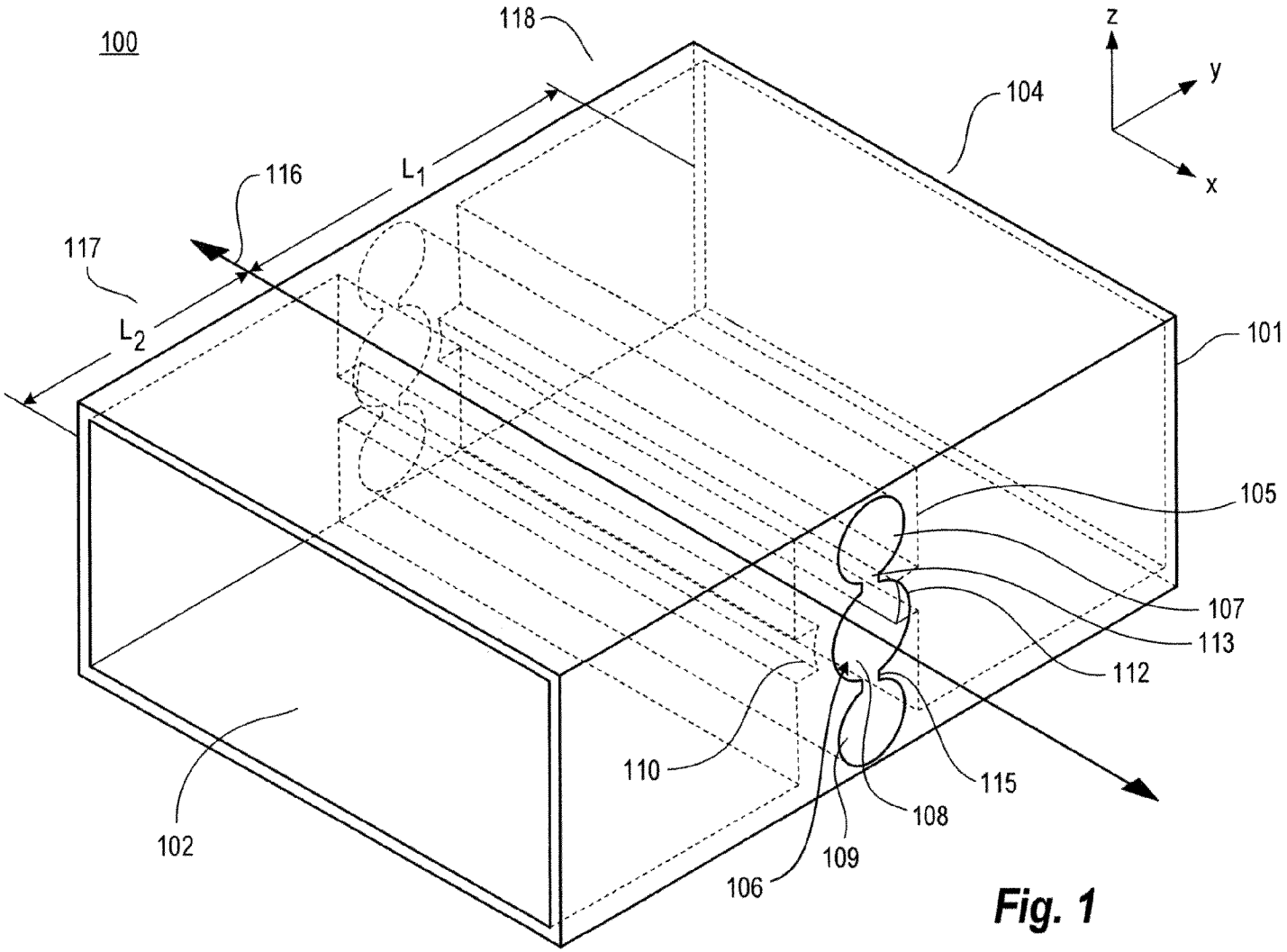
FIG. 1 is a perspective view of an apparatus according to an example embodiment.

FIG. 1 is a perspective view of a portion of an apparatus 100 according to a first example embodiment. Apparatus 100 may comprise a waveguide-based apparatus for exciting and sustaining a plasma.

To facilitate a better understanding of the description below, FIG. 1 also shows a set of three orthogonal directions, x, y, and z, which together span a three-dimensional space. In the description below, the x, y, and z directions are designated "width," "length," and "height," respectively. Of course it should be understood that the assignment of the terms "width," "length," and "height" to the x, y, and z directions, respectively, in this disclosure is arbitrary and the terms could be assigned differently. To facilitate a better understanding of the embodiments disclosed herein, various combinations of the x, y, and z directions are shown in various drawings, but in all cases the directions are used consistently throughout the drawings.

Apparatus 100 comprises an electromagnetic waveguide ("waveguide") 101 which is configured to support a desired propagation mode ("mode") at a frequency suitable for generating and sustaining a plasma, and an iris 106 where a plasma torch (not shown in FIG. 1, but see FIGS. 5 and 6 below) is disposed.

Waveguide 101 is configured to support a desired mode of propagation (e.g., $TE_{10}$) at a microwave frequency. Although the embodiment of waveguide 101 illustrated in FIG. 1 is a rectangular box with a rectangular cross section across the direction of propagation (the y-direction), it will be understood that other waveguide shapes with other types of cross-sections are contemplated. In apparatus 100, waveguide 101 is disposed adjacent to a source of microwave energy (not shown) at a first end 102 thereof, and is short-circuited at a second end 104 which is separated and spaced apart from first end 102 along the y-direction to define the length of waveguide 101.

Iris 106 is provided in waveguide 101 by an iris structure 105 which defines an iris hole 108 with a first iris slot 110 disposed at or along a first side of iris hole 108, a second iris slot 112 disposed at or along a second side of iris hole 108, a third iris slot 113 at a top side of the iris hole, and a fourth iris slot 115 at a bottom side of the iris hole. The first and second sides of iris hole 108 are separated and spaced apart from each other in the y-direction, while the top side and bottom side of iris hole 108 are separated and spaced apart from each other in the z-direction. First, second, third and fourth iris slots 110, 112, 113 and 115 are in communication with iris hole 108.

In operation, an electromagnetic wave may propagate from first end 102 of waveguide 101 along the y-direction, pass through first iris slot 110, iris hole 108, and second iris slot 112, and reach second end 104 of waveguide 101.

In the embodiment illustrated in FIG. 1, iris hole 108 has a cylindrical shape, having a principal axis 116 of the cylinder extending in the x-direction across the width of waveguide 101 and having a substantially circular cross-section in a plane defined by the y-direction and z-direction. In other embodiments, iris hole 108 may have a shape which is not cylindrical. For example, in some embodiments iris hole 108 may have the shape of a rectangular prism, a hexagonal prism, an octagonal prism, an oval cylinder, etc. In some embodiments, the iris hole is symmetrical around an axis and has no sharp angles. First and second iris slots 110 and 112 may be disposed at or along opposite sides of iris hole 108 with respect to each other in the y-direction (i.e., the direction of propagation of waveguide 101), and third and fourth iris slots 113 and 115 may be disposed at or along opposite sides of iris hole 108 with respect to each other in the z-direction (perpendicular to the direction of propagation of waveguide 101). First, second, third, and fourth iris slots 110, 112, 113 and 115 may have the same size and shape as each other, or the sizes and/or shapes may be different from each other.

Iris 106 further includes a first cavity 107 is disposed above iris hole 108, and a second cavity 109 is disposed below iris hole 108. In some embodiments, first and second cavities 107 and 109 each may comprise a cylindrical bore or hole through iris structure 105 with a principal axis extending in the x-direction. In other embodiments, first and second cavities 107 and 109 may have different shapes, for example a half-cylindrical shape, the shape of a rectangular cuboid, etc.

In some embodiments, the center of the iris 106 (e.g. at principal axis 116) is disposed at a distance (represented as a first length L1 in FIG. 1) in the y-direction from first end 102 of waveguide 101. Moreover, in some embodiments, the center of the iris 106 (e.g. at principal axis 116) is disposed a distance (represented as a second length L2 in FIG. 1) in the y-direction from second end 104 of waveguide 101. As such, iris 106 is positioned between a first portion 117 of the waveguide 101 and a second portion 118 of the waveguide 101. Notably, the waveguide 101 may be a single piece comprising first and second portions 117, 118 with iris 106 positioned therein. Alternatively, waveguide 101 may comprise two separate pieces (e.g., first and second portions 117, 118 being separate pieces) with iris 106 positioned therebetween.

Figure 4:
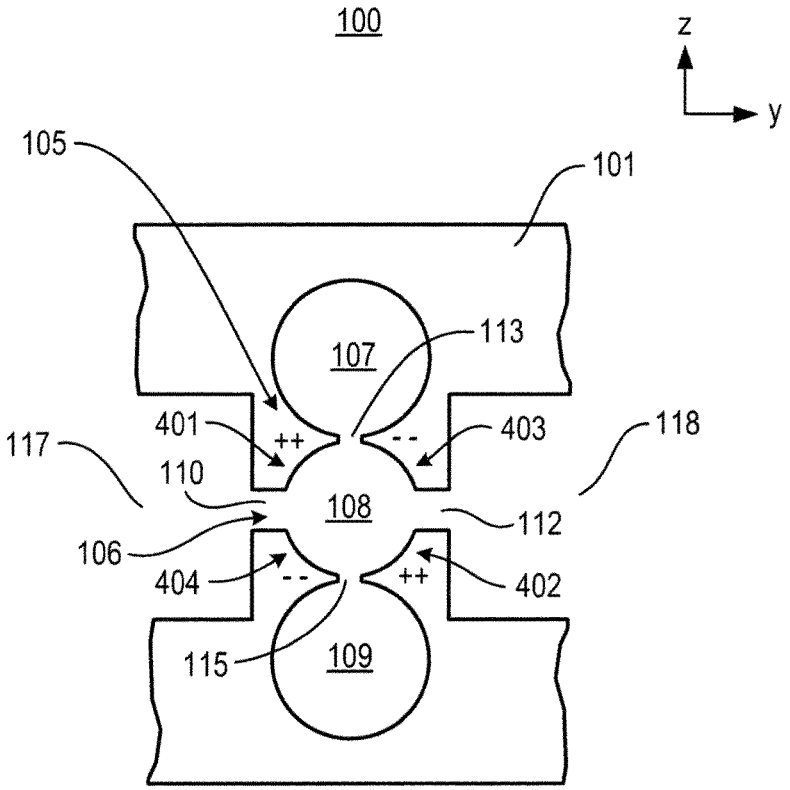
FIG. 4 is a side view of a cross-section of a portion of an apparatus according to an example embodiment.
Figure 5:
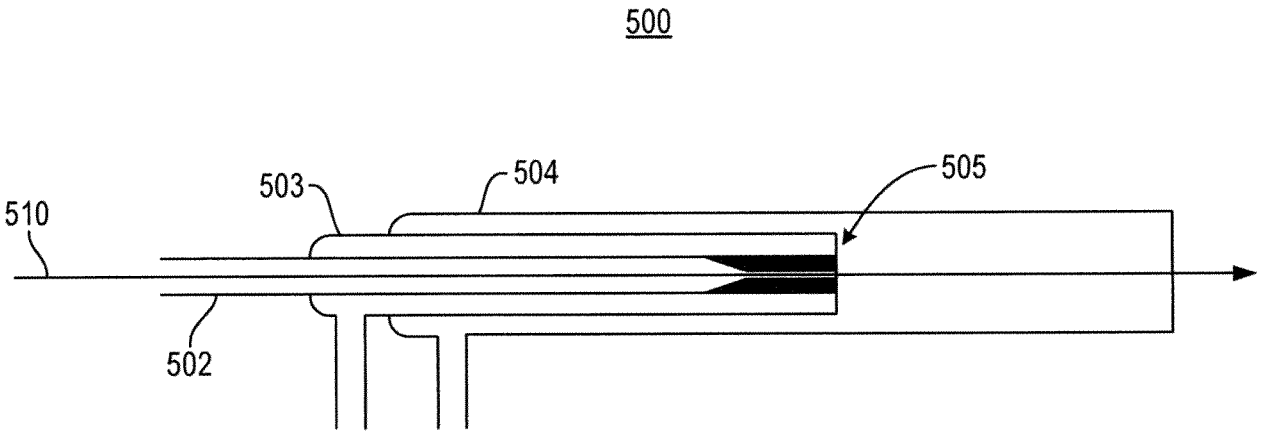
FIG. 5 is an end view of an example embodiment of a plasma torch.

In some embodiments, iris structure 105 which defines iris 106 may be a metal section having a thickness dimension along the length (y-direction) of waveguide 101, with a through-hole extending in the x-direction through the width of the metal section to define iris hole 108 which is configured to accommodate therein a plasma torch (see FIGS. 4 and 5). Waveguide 101 and iris structure 105 defining iris 106 in apparatus 100 are each made of a suitable electrically conductive material, such as a metal (e.g. aluminum) or metal alloy suitable for use at the selected frequency of operation of the apparatus 100. In some embodiments, iris structure 105 may be integral to waveguide 101. In other embodiments, iris structure 105 may be a separate structure inserted in waveguide 101. Certain aspects of waveguide 101 and iris 106 are common to the corresponding features described in commonly owned U.S. Pat. No. 6,683,272 to Hammer. The disclosure of U.S. Pat. No. 6,683,272 is specifically incorporated by reference herein.

Figure 2:
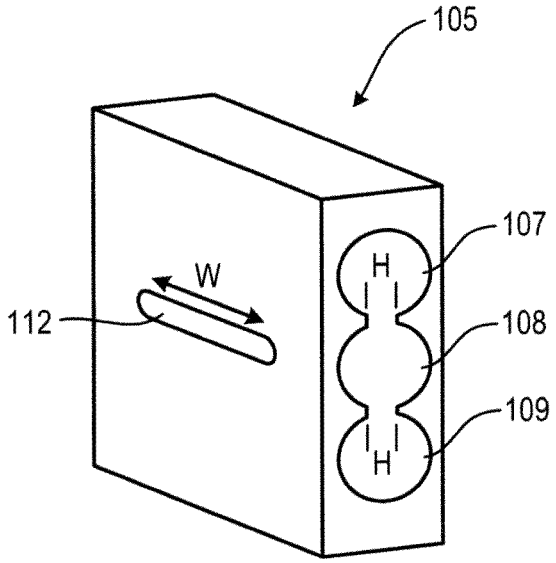
FIG. 2 is a perspective view of an iris structure according to an example embodiment.

FIG. 2 is a perspective view of an example embodiment of iris structure 105 for defining iris 106 which more clearly illustrates first and second cavities 107 and 109.

Figure 3:
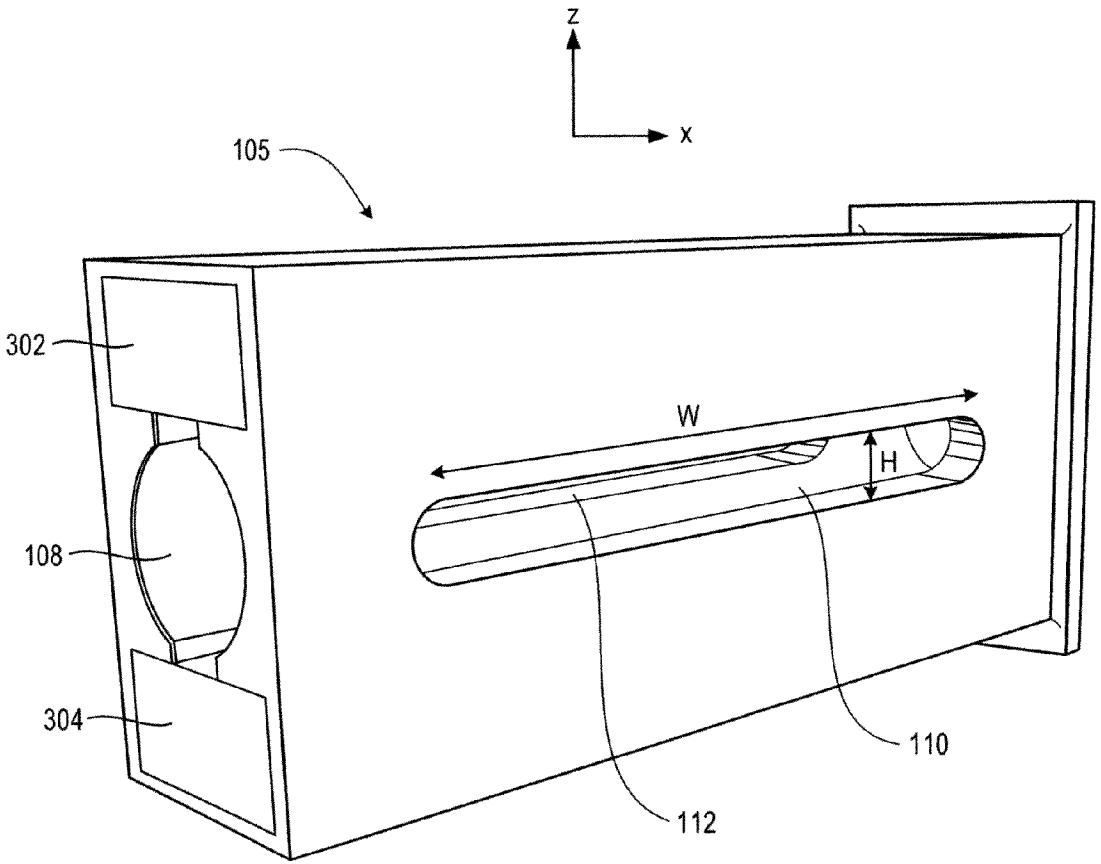
FIG. 3 is a perspective view of an iris structure according to an example embodiment.

FIG. 3 is another perspective view of iris structure 105 for defining iris 106. FIG. 3 illustrates an embodiment where electrically conductive (e.g., aluminum or other conductive metal) plates 302 and 304 are disposed over ends of first second cavities 107 and 109 to prevent radiation of the microwave energy from apparatus 100.

As illustrated in FIGS. 2 and 3, iris slot 112 has a height H in the z-direction, and a width W in the x-direction. In the illustrated embodiment, the height H is less than the height of waveguide 101 in the z-direction, and the width W is less than the width of waveguide 101 in the x-direction. As mentioned above, it should be understood that first iris slot 110, which is only partially seen in FIG. 3, may have the same configuration as second iris slot 112, or its size and/or shape may be different.

FIG. 4 is a side view of a cross-section of a portion of apparatus 100, illustrating an example embodiment of iris 106 having first through fourth iris slots 110, 112, 113 and 115.

As noted above, iris hole 108 is configured to accommodate therein a plasma torch. A plasma torch is a device with a conduit or channel for delivering a plasma gas, which, upon contacting the electromagnetic waves, produces a plasma. The plasma torch may also comprise a conduit or channel for delivering a sample in the form of an aerosol or gas to a location where plasma forms. Plasma torches are known in the art.

FIG. 5 is an end view of an example embodiment of a plasma torch 500. Plasma torch 500 includes three concentric injectors or tubes 502, 503, 504, each of which may be made of a non-conducting material, such as quartz or ceramic. The concentric tubes of plasma torch 500 share a common central longitudinal axis 510 which, when plasma torch 500 is inserted into iris hole 108, may be oriented parallel to, or aligned with, the principal axis 116 of iris hole 108, as shown in FIG. 1.

Figure 6:
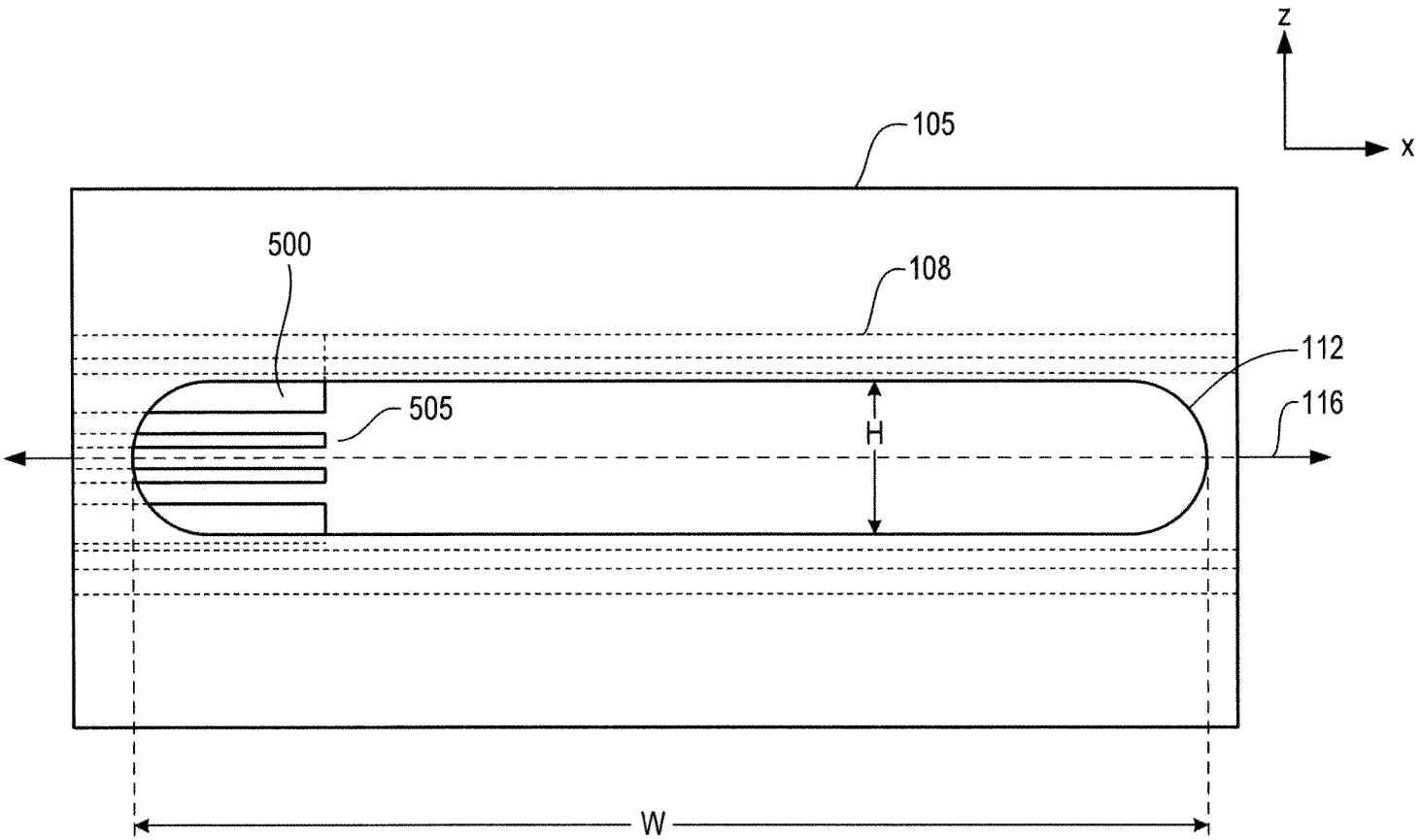
FIG. 6 is an end view illustrating an example embodiment of an iris structure with a plasma torch disposed therein.

FIG. 6 is an end view of a portion of an example embodiment of an apparatus including iris structure 105 with plasma torch 500 disposed therein. As shown in FIGS. 5 and 6, plasma torch 500 includes a tip 505, and is inserted in iris hole 108.

In operation, plasma torch 500 generates a plasma in iris hole 108. When plasma torch 500 is inserted into iris hole 108, a carrier gas with an entrained sample to be spectroscopically analyzed normally flows through innermost tube 502, an intermediate gas flow is provided in intermediate tube 503, and a plasma-sustaining and torch-cooling gas flow is provided in outermost tube 504. In some embodiments, the plasma-sustaining and torch-cooling gas may be nitrogen, and arrangements are provided for producing a flow of this gas conducive to form a stable plasma having a substantially hollow core, and to prevent plasma torch 400 from becoming overheated. For example, in some embodiments the plasma-sustaining gas may be injected radially off-axis so that the flow spirals. This gas flow sustains the plasma and the analytical sample carried in the inner gas flow is heated by radiation and conduction from the plasma. In some embodiments, for the purpose of initially igniting the plasma, the plasma-sustaining and torch-cooling gas flow may temporarily and briefly be changed, for example, from nitrogen to argon.

A more detailed description of an example embodiment of a plasma torch is described in detail in commonly owned U.S. Pat. No. 7,030,979 to Hammer. The disclosure of U.S. Pat. No. 7,030,979 is specifically incorporated herein by reference. It will be understood that other configurations of a plasma torch, and other suitable means of injecting the sample to be analyzed and the plasma gas into iris 106, are contemplated.

As indicated above, a selected mode is supported in an waveguide 101 when not perturbed. However, the iris 106 presents a perturbation that alters the wavelength and shape of the mode in the waveguide 101. By virtue of the structure of waveguide 101 and iris 106 including the first, second, third, and fourth iris slots 110, 112, 113 and 115, a plasma may be generated and sustained in a desired shape.

In some embodiments, waveguide 101 may be configured to support a $TE_{10}$ propagation mode having a frequency in the microwave portion of the electromagnetic spectrum. For example, in some embodiments the selected mode may have a characteristic frequency of approximately 2.45 GHz. Notably, however, the embodiments described herein are not limited to operation at 2.45 GHz, and in general not limited to operation in the microwave spectrum. In particular, because the operational frequency range which is selected dictates the wavelength of the selected mode(s) of operation, and the operational wavelengths are primarily limited by the geometric sizes of plasma torch 500 and waveguide 101, the operational frequency is also limited by the geometric size of plasma torch 500 and waveguide 101. Illustratively, the present teachings can be readily implemented to include operational frequencies both higher and lower that 2.45 GHz. Furthermore, the desired mode is not limited to the illustrative $TE_{10}$ mode, and the waveguide 101 (or first and/or second portions 117, 118 depicted in FIG. 1) is not necessarily rectangular in shape. Other modes, or waveguide shapes, or both, are contemplated by the present disclosure.

The present inventors have discovered that by adding to the first and second iris slots 110 and 112 additional iris slots—and in particular third and fourth iris slots 113 and 115 which are connected respectively to first and second cavities 107 and 109—the electric field may be caused to experience a phase shift or change in direction from first iris slot 110 to second iris slot 112. In particular, the present inventors have discovered that in some embodiments the electric field may be caused to experience a phase shift of 180 degrees, that is a reversal in direction from first iris slot 110 to second iris slot 112, such that the electric field at second iris slot 112 is in an opposite direction from the electric field at first iris slot 110.

In some embodiments, the heights H of third and fourth iris slots 113 and 115 are about the same as the heights H of first and second iris slots 110 and 112.

As shown in FIG. 4, in the illustrated embodiment the first slots disposed at the top, bottom, and sides of iris hole 108 establish a quadrupole (i.e., 4-pole) arrangement, with two positive electrodes or poles 401 and 402 at opposite sides of iris hole 108, and two negative electrodes or poles 403 and 404 at opposite sides of iris hole 108. In some embodiments where the heights H of third and fourth iris slots 113 and 115 are about the same as the heights H of first and second iris slots 110 and 112, positive poles 401 and 402 are rotated 90 degrees with respect to negative poles 403 and 404, respectively.

Figure 7A:
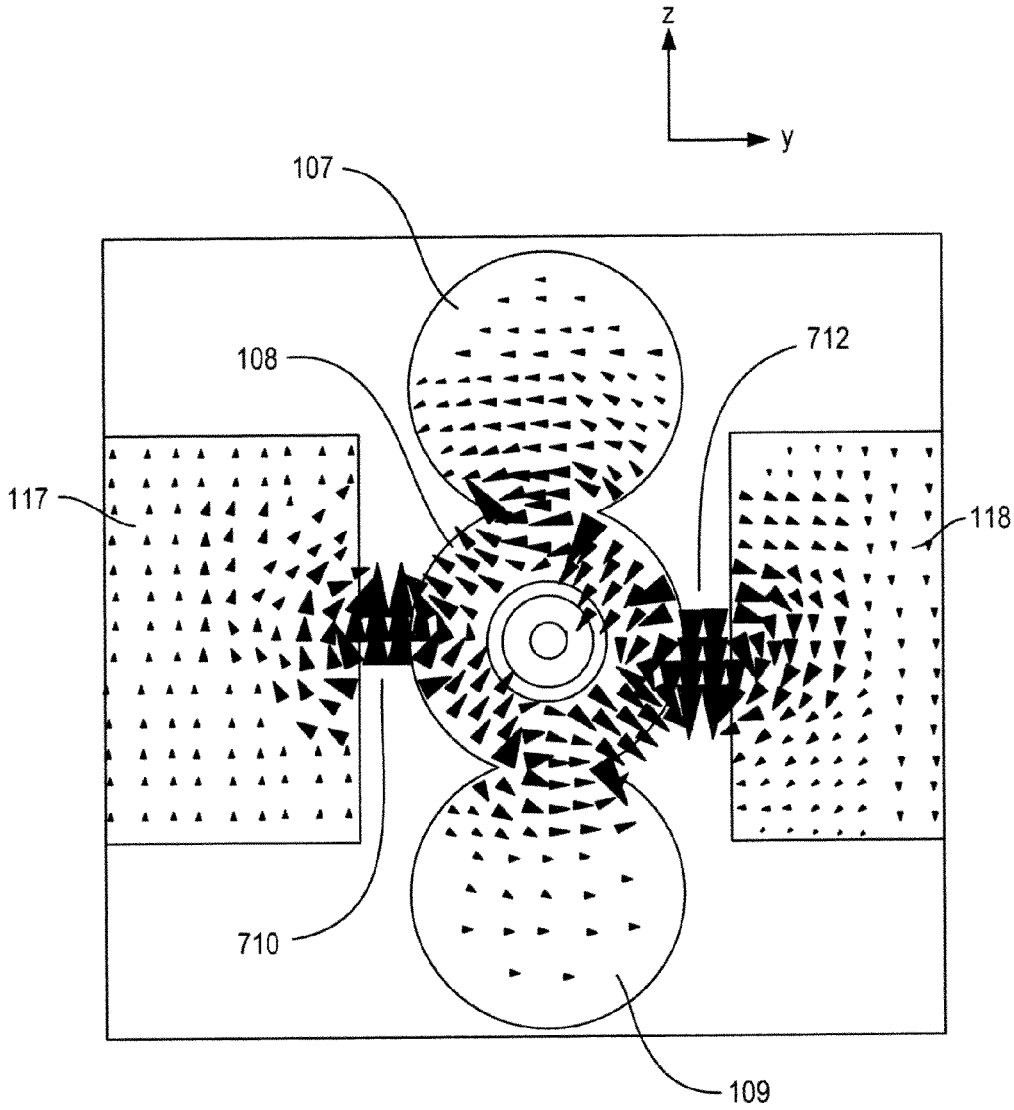
FIG. 7A is a side view depicting an example of electric field lines of a desired mode in the region of an iris according to the first embodiment.

FIG. 7A is a side view depicting an example of electric field lines of a desired mode in the region of iris 106 in an apparatus according to the example embodiment having first through fourth iris slots 110, 112, 113 and 115. As illustrated in FIG. 7A, the presence of third and fourth iris slots 113 and 115 connected to first and second cavities 107 and 109, respectively, causes the electric field lines 710 to be rotated or turned in direction around the interior of iris hole 108. In particular, the electric field lines 710 at first iris slot 110 at a first side of iris hole 108 are oriented in the opposite direction from the electric field lines 712 at second iris slot 112 at the second side of iris hole 108 which is opposite the first side of iris hole 108. Accordingly, third and fourth iris slots 113 and 115 operate in conjunction with first and second cavities 107 and 109 as an electric field rotation arrangement configured to establish a quadrupole (i.e., 4-pole) electric field around a circumference of iris hole 108.

It is noted that the magnetic field produced by iris 106 is not axial. In other words, iris 106 does not produce a significant axial magnetic field component extending along the principal axis 116 of iris hole 108. In an ideal case, there is no axial magnetic field extending along a longitudinal axis of the plasma torch (i.e., the axial magnetic field is zero).

Figure 7B:
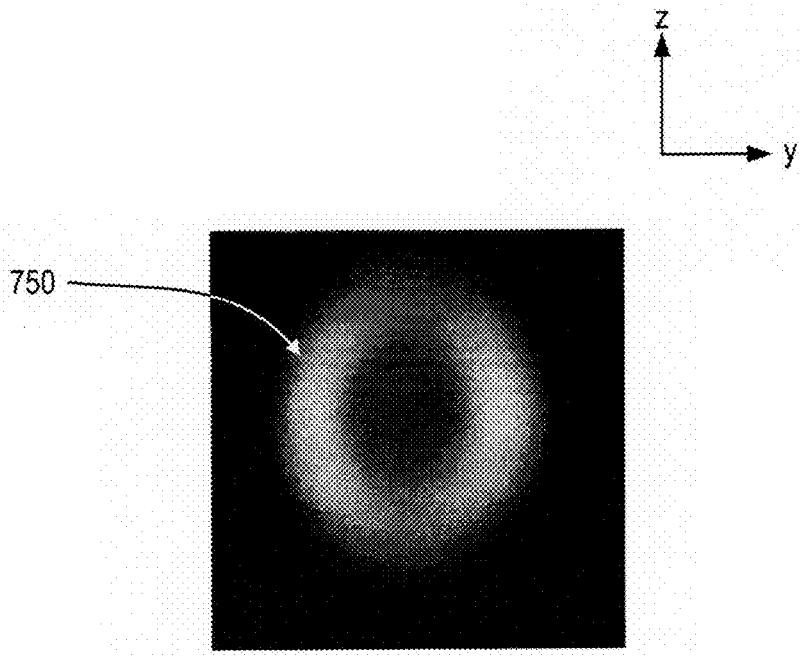
FIG. 7B is a side view on an example of a plasma generated by an example embodiment of a plasma source.

FIG. 7B is a side view of an example of a plasma 750 which may be generated by an example embodiment of a plasma source including the apparatus 100 and the iris 106 having iris hole 108 with the presence of third and fourth iris slots 113 and 115 connected to first and second cavities 107 and 109, respectively. As can be seen from FIG. 7B, plasma 750 has the shape of a cylindroid (e.g., elliptic cylinder), extending lengthwise in the x-direction and having an elliptical cross-section in a plane defined by the y-direction and the z-direction, and may have so-called "cold spots" at the top and bottom, which are localized areas in the plasma which have a reduced concentration of ions and/or electrons. A plasma, such as plasma 750, which includes such one or more such cold spots is referred to in this specification and the attached claims as a quasi-toroidal plasma. Although FIG. 7B illustrates an example of a plasma having a quasi-toroidal shape, in other embodiments a plasma having a different shape may be generated. In some embodiments, the plasma may be symmetrical, or quasi-symmetrical (that is, symmetrical except for the presence of one or more cold spots, as discussed above), about central longitudinal axis 510 with a somewhat cooler central core—for example the plasma may be toroidal, or may have the shape of a hollow rectangular prism.

Iris structure 105 as described above defines exactly four iris slots 110, 112, 113 and 115 equally spaced about the perimeter of iris hole 108 for forming a quadrupole electrical field. However, in other embodiments the number of iris slots may be different than four. In general, in various embodiments the number of iris slots may be 2N, where N is an integer of at least two, and may establish a 2N-pole electric field around a circumference of the iris hole. In some embodiments, N is 2, 3, 4, 5, 6, 7, or 8.

In some embodiments, a dielectric material may be disposed in iris hole 108 which may facilitate a rotation in direction of the electric field from first iris slot 110 to second iris slot 112. Further details regarding the use of such a dielectric material may be found in co-pending U.S. patent application Ser. No. 13/838,474, "Waveguide-Based Apparatus for Exciting and Sustaining a Plasma," in the names of Mehrnoosh Vahidpour et al., filed on even date with the present patent application, the disclosure of which is hereby incorporated herein in its entirety as if fully set forth herein.

Embodiments of a waveguide-based apparatus for exciting and sustaining a plasma as described above may be employed in various systems and for various applications, including but not limited to an atomic emission spectrometer (AES) for performing atomic emission spectroscopy or a mass spectrometer for performing mass spectrometry. In some embodiments, a spectrograph (e.g., an Echelle spectrograph) may be employed to separate atomized radiation emitted by the plasma into spectral emission wavelengths that are imaged onto a camera to produce spectral data, and a processor or computer may be employed to process and display and/or store the spectral data captured by the camera.

Exemplary Embodiments

In addition to the embodiments described elsewhere in this disclosure, exemplary embodiments of the present invention include, without being limited to, the following:

1. An apparatus, comprising:
an electromagnetic waveguide; and
an iris structure providing an iris in the electromagnetic waveguide, the iris structure defining an iris hole, a first iris slot along a first side of the iris hole, a second iris slot at a second side of the iris hole which is opposite the first side, a third iris slot at a third side of the iris hole, and a fourth iris slot at a fourth side of the iris hole opposite the third side,
wherein the first and second iris slots are configured such that an electromagnetic wave may propagate from a first end of the electromagnetic waveguide, and pass through the first iris slot, the iris hole, and the second iris slot.

2. The apparatus of embodiment 1, further comprising:
a first cavity in the iris structure disposed at the third side of the iris hole and being connected to the iris hole by the third iris slot; and
a second cavity in the iris structure disposed at the fourth side of the iris hole and being connected to the iris hole by the fourth iris slot.

3. The apparatus of any of the embodiments 1-2, further comprising a plasma torch disposed within the iris hole, wherein the plasma torch is configured to generate a plasma in the iris hole, and wherein the plasma is symmetrical or quasi-symmetrical around a longitudinal axis of the plasma torch.

4. The apparatus of embodiment 3, wherein the plasma has a toroidal or quasi-toroidal shape.

5. The apparatus of any of the embodiments 1-4, wherein, in operation, an electric field in the waveguide changes direction from the first iris slot to the second iris slot.

6. The apparatus of embodiment 5, wherein the electric field at the second iris slot is in an opposite direction from the electric field at the first iris slot.

7. The apparatus of any of the embodiments 3-6, wherein in operation there is no axial magnetic field extending along a longitudinal axis of the plasma torch.

8. An apparatus, comprising:
an electromagnetic waveguide;
an iris structure providing an iris in the electromagnetic waveguide, the iris structure defining an iris hole; and
an electric field rotation arrangement configured to establish a 2N-pole electric field around a circumference of the iris hole, wherein N is an integer which is at least two.

9. The apparatus of embodiment 8, wherein the electric field rotation arrangement comprises at least four iris slots defined by the iris structure and disposed around sides of the iris hole.

10. The apparatus of any of the embodiments 8-9, further comprising a plasma torch disposed within the iris hole, wherein the plasma torch is configured to generate a plasma in the iris hole, and wherein the plasma is symmetrical or quasi-symmetrical around a longitudinal axis of the plasma torch.

11. The apparatus of embodiment 10, wherein the plasma has a toroidal or quasi-toroidal shape.

12. The apparatus of any of the embodiments 8-11, wherein the electric field changes direction from a first side of the iris hole to a second side of the iris hole which is opposite the first side.

13. The apparatus of embodiment 12, wherein the electric field at the second side of the iris hole is an opposite direction from the electric field at the first side of the iris hole.

14. The apparatus of embodiment 13, wherein N is two.

15. The apparatus of any of the embodiments 8-14, further comprising a dielectric material disposed in the iris hole.

16. An apparatus, comprising:
an electromagnetic waveguide;
an iris structure providing an iris in the electromagnetic waveguide, the iris structure defining an iris hole and at least four iris slots each in communication with the iris hole, wherein a first one of the iris slots is disposed at a first side of the iris hole and a second one of the iris slots is disposed at a second side of the iris hole which is opposite the first side.

17. The apparatus of embodiment 16, wherein the at least four iris slots are comprise exactly four iris slots.

18. The apparatus of any of the embodiments 16-17, further comprising a plasma torch disposed within the iris hole, wherein the plasma torch generates a plasma in the iris hole, and wherein the plasma is quasi-symmetrical around a longitudinal axis of the plasma torch.

19. The apparatus of embodiment 18, wherein the plasma has a quasi-toroidal shape.

20. The apparatus of any of the embodiments 16-19, wherein an electric field in the waveguide changes direction from the first iris slot to the second iris slot.

21. An atomic emission spectrometer comprising the apparatus of any of the embodiments 1-20.

22. A mass spectrometer comprising the apparatus of any of the embodiments 1-20.

23. A method, comprising:

causing an electromagnetic wave to propagate from a first end of the electromagnetic waveguide in the apparatus of any of the preceding embodiments and pass through the first iris slot, the iris hole, and the second iris slot.

24. The method of embodiment 23, further comprising:

providing a plasma forming gas to the plasma torch; and generating a plasma.

25. The method of embodiment 23, further comprising contacting a sample with the plasma and analyzing the content of the sample.

A number of embodiments of the invention have been described. Nevertheless, one of ordinary skill in the art appreciates that many variations and modifications are possible without departing from the spirit and scope of the present invention and which remain within the scope of the appended claims. The invention therefore is not to be restricted in any way other than by the scope of the claims.

What is claimed is:

1. An apparatus, comprising:

an electromagnetic waveguide; and an iris structure providing an iris in the electromagnetic waveguide, the iris structure defining an iris hole, a first iris slot along a first side of the iris hole, a second iris slot at a second side of the iris hole which is opposite the first side, a third iris slot at a third side of the iris hole, and a fourth iris slot at a fourth side of the iris hole which is opposite the third side, wherein the first and second iris slots are configured such that an electromagnetic wave can propagate from a first end of the electromagnetic waveguide and pass through the first iris slot, the iris hole, and the second iris slot.

2. The apparatus of any of claim 1, further comprising:

a first cavity in the iris structure disposed at the third side of the iris hole and being connected to the iris hole by the third iris slot; and a second cavity in the iris structure disposed at the fourth side of the iris hole and being connected to the iris hole by the fourth iris slot.

3. The apparatus of claim 1, further comprising a plasma torch disposed within the iris hole, wherein the plasma torch is configured to generate a plasma in the iris hole, and wherein the plasma is quasi-symmetrical around a longitudinal axis of the plasma torch.

4. The apparatus of claim 3, wherein the plasma has a quasi-toroidal shape.

5. The apparatus of claim 3, wherein, in operation, an electric field in the waveguide changes direction from the first iris slot to the second iris slot.

6. The apparatus of claim 5, wherein the electric field at the second iris slot is in an opposite direction from the electric field at the first iris slot.

7. The apparatus of claim 3, wherein in operation there is no axial magnetic field extending along a longitudinal axis of the plasma torch.

8. An apparatus, comprising:

an electromagnetic waveguide;

an iris structure providing an iris in the electromagnetic waveguide, the iris structure defining an iris hole; and an electric field rotation arrangement configured to establish a 2N-pole electric field around a circumference of the iris hole, wherein N is an integer which is at least two.

9. The apparatus of claim 8, wherein the electric field rotation arrangement comprises at least four iris slots defined by the iris structure and disposed around sides of the iris hole.

10. The apparatus of claim 8, further comprising a plasma torch disposed within the iris hole, wherein the plasma torch is configured to generate a plasma in the iris hole, and wherein the plasma is quasi-symmetrical around a longitudinal axis of the plasma torch.

11. The apparatus of claim 10, wherein the plasma has a quasi-toroidal shape.

12. The apparatus of claim 8, wherein the electric field changes direction from a first side of the iris hole to a second side of the iris hole which is opposite the first side.

13. The apparatus of claim 12, wherein the electric field at the second side of the iris hole is an opposite direction from the electric field at the first side of the iris hole.

14. The apparatus of claim 13, wherein N is two.

15. The apparatus of claim 8, further comprising a dielectric material disposed in the iris hole.

16. An atomic emission spectrometer comprising the apparatus of claim 1.

17. A mass spectrometer comprising the apparatus of claim 1.

* * * * *

UNITED STATES PATENT AND TRADEMARK OFFICE

CERTIFICATE OF CORRECTION

PATENT NO. : 8,773,225 B1
APPLICATION NO. : 13/839028
DATED : July 8, 2014
INVENTOR(S) : Mehrnoosh Vahidpour et al.

It is certified that error appears in the above-identified patent and that said Letters Patent is hereby corrected as shown below:

In the Claims

In column 9, line 44, in claim 2, after "of" delete "any of".

Signed and Sealed this
Thirtieth Day of June, 2015

Michelle K. Lee

Michelle K. Lee
*Director of the United States Patent and Trademark Office*